United States Patent [19]

Bonanomi

[11] Patent Number: 4,860,471

[45] Date of Patent: Aug. 29, 1989

[54] DISPLAY MEANS

[75] Inventor: Jacques Bonanomi, Neuchatel, Switzerland

[73] Assignee: Observatorie Cantonal, Switzerland

[21] Appl. No.: 105,099

[22] Filed: Oct. 5, 1987

[30] Foreign Application Priority Data

Oct. 6, 1986 [FR] France ..... 86 13983

[51] Int. Cl.[4] ..... G09F 3/04

[52] U.S. Cl. ..... 40/450; 40/470; 40/492

[58] Field of Search ..... 40/447, 449; 340/815.04

[56] References Cited

U.S. PATENT DOCUMENTS

| | | | |
|---|---|---|---|
| 3,975,728 | 8/1976 | Winrow | 40/447 |
| 4,531,318 | 7/1985 | Chang et al. | 40/447 |
| 4,627,182 | 12/1982 | Weiss | 40/447 |

*Primary Examiner*—Gene Mancene
*Assistant Examiner*—Wenceslao J. Contreras
*Attorney, Agent, or Firm*—Davis, Bujold & Streck

[57] ABSTRACT

The present invention concerns a display means.

This display means comprises a thin, light pivoting flap (5) with two principal surfaces (6, 6') and a rotating stepping motor (13). The motor drives the shutter by means of an elastic device (16) which times motor acceleration. A predetermined number of motor steps corresponds to one complete rotation of the flap.

The display means is used to form large display units for train stations, airports, etc.

6 Claims, 2 Drawing Sheets

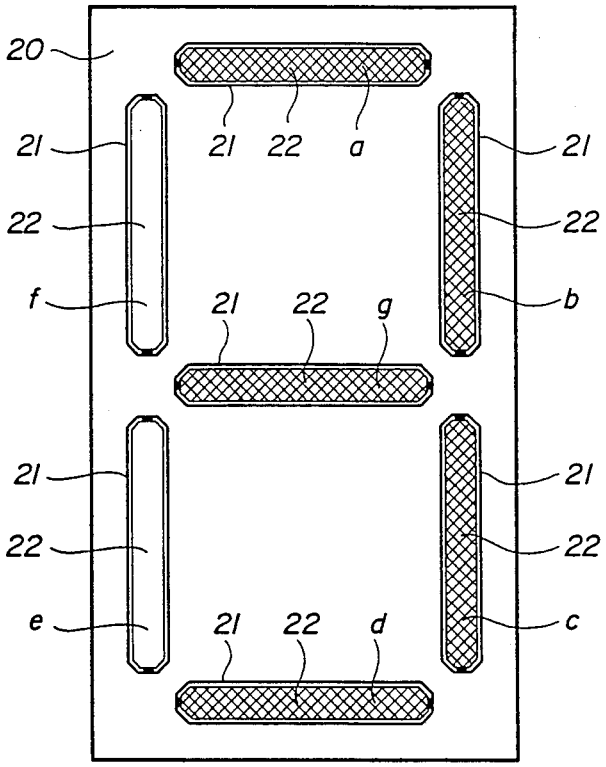
FIG. 2
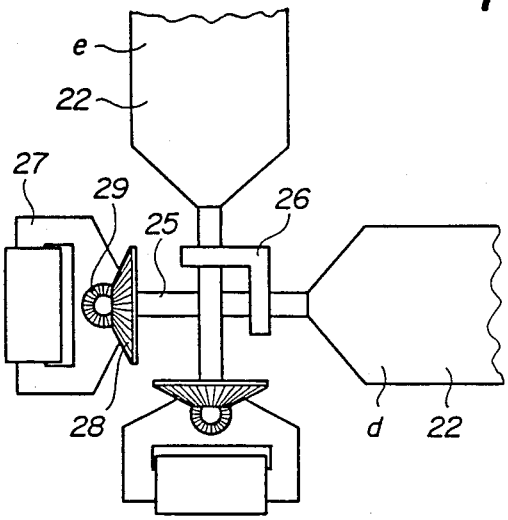
FIG. 3A
FIG. 3B
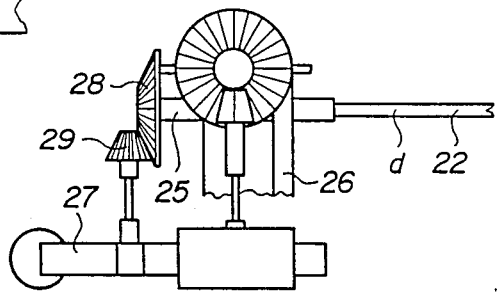

DISPLAY MEANS

The present invention concerns a display means comprising at least one pivoting element with a low moment of inertia having several principal surfaces of different colors and a rotating stepping motor designed to rotate the pivoting element at an angle of less than 15° per step.

Such display means are well known, and numerous examples of various shapes and sizes exist within the industry. These enable large display units to be constructed which might, for example, display time throughout a building, outdoor temperature or even schedules in train stations or airports.

European Patent Application Published as No. 0 093 600, for example, describes in detail a unit with a pivoting means designed to be used in a matrix display unit of large proportions. In this embodiment, the pivoting means is a cylinder of square cross section. It is mounted directly on the shaft of a stepping motor which causes it to turn around its axis of symmetry 90° with each step. The cylinder comprises four principal surfaces, pairs of which are mutually perpendicular, and which are successively displaced in front of an opening in the front cover or screen during each step of the motor. One of the principal surfaces is the same color as the visible side of the cover, while the other surfaces are two different colors. A display unit formed of such elements may show symbols, numerals or letters, for example, in three different colors, or may be neutral in color.

In this embodiment, the portion of the pivoting means having the greatest mass is located on the periphery, thereby resulting in a high moment of inertia. Furthermore, this means rotates at a fairly large angle with each step of the motor. There results a considerable loss of energy with each rotation of the cylinder, which increases rapidly as dimension increases. To overcome this loss and ensure reliable functioning of the display means, the motor must generate considerable energy and therefore consumes a good deal of electricity.

The embodiments cited above related to fixed units which were fed by an energy network. Under such conditions, energy consumption has only secondary importance, even though it is desirable for it be as low as possible. This is why energy consumption has not been lowered in movable display units known in the art.

Recent progress in the fields of microelectronics and batteries now make it possible for such units to be self-energizing. Integrated circuits made, for example, in accordance with CMOS technology, semi-conductor metal oxide with complementary symmetry, consume very little energy yet have a high density, thereby permitting complex functions to be performed. Typically, energy consumption is of the order of 100 μA and can fall below 1 μA in watch circuitry. Furthermore, recently developed lithium batteries have high specific energy and, more importantly, a very low rate of auto-discharge, thereby giving them a life of ten or more years.

Examples of information which might be displayed are temperature, the exact time, or any other information which may be radio transmitted to a receiver connected to a display unit. Thus, displaying the time throughout a city, a region or even a country would be easily accomplished with a network of automatic digital clocks synchronized by radio signal if a large enough display unit with low energy consumption existed. It is obvious that such a display of time would offer many advantages over display units utilizing non-automatic clocks, particularly the advantage of being a simple construction and one requiring little maintenance or surveillance.

Given the fact that large display means with pivoting elements and low energy consumption do not exist, it should be noted that similar display means are known in the art. It is obvious that in the case of active display means, high luminous energy is required, but results in low output. For liquid crystal display means, energy consumption is of the order of 15 nA under 3 V per square mm of liquid crystal activated. A seven-segment display 10 cm high and 6 cm wide with an active surface of 12 square centimeters thus consumes 54 μW of energy. This level of consumption might be considered exorbitant, especially for a display means which is not reliable under severe conditions.

The principal object of the invention is to provide a large display unit with a pivoting means and with low energy consumption.

To this end, the display means according to the invention is characterized by the fact that the motor drives the pivoting element by means of an elastic device which times the accelerations of the stepping motor.

According to a preferred embodiment, the pivoting element is a narrow flap with two essentially rectangular principal surfaces. The flap is preferably made of a thin sheet of metal or heat-molded of synthetic material. According to another embodiment, the elastic means is preferably a band of metallic wire.

The stepping motor is preferably a watch movement.

Other characteristics and advantages of the present invention will be obvious from the following description with reference to the accompanying drawings which provide, by way of non-limiting examples, a preferred embodiment of a display unit with pivoting means. In the drawings, where like elements bear the same reference numerals:

FIG. 2 is a plane view of an example of a display means using seven display segments according to the invention; and FIGS. 3A and 3B are plane and elevational views, respectively, of a possible embodiment of the drive mechanism for the two flaps contiguous to the display unit shown in FIG. 2.

Figure 1:
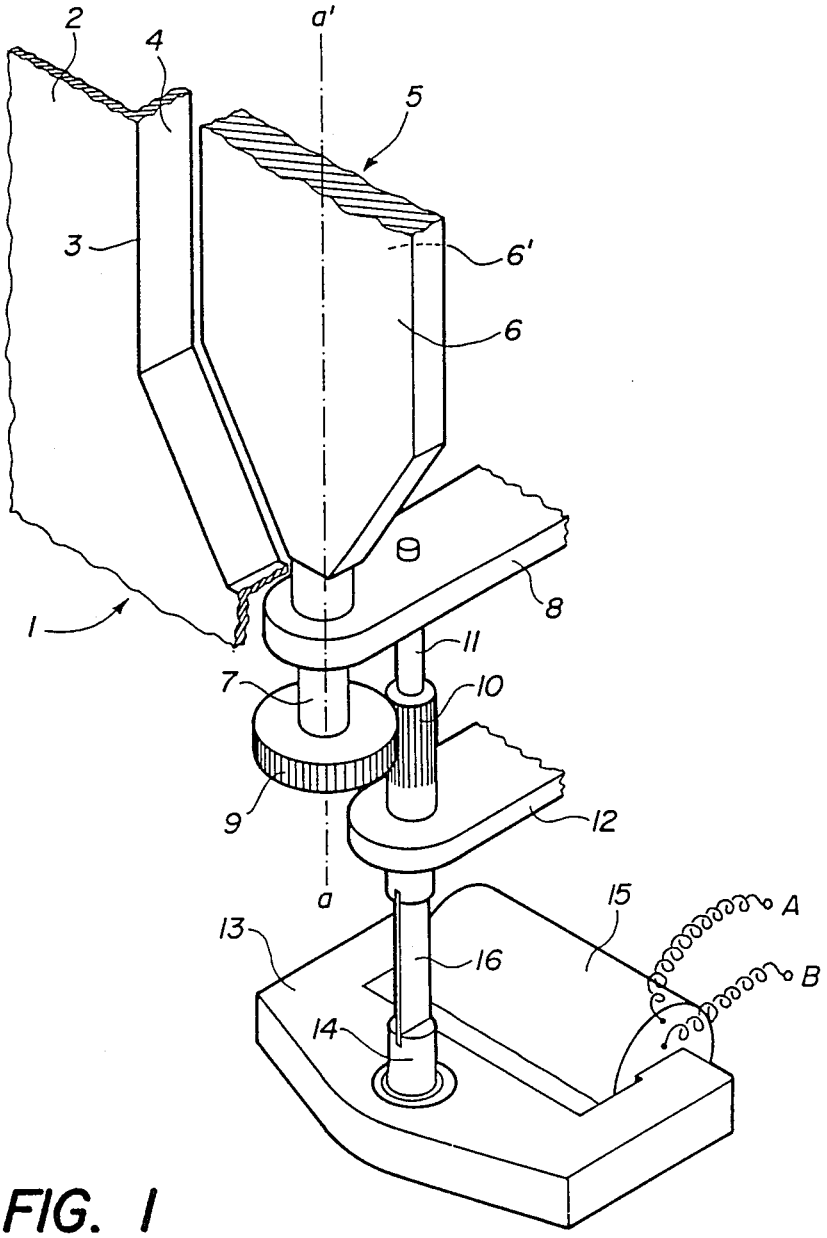
FIG. 1 is a view partly in perspective of a preferred embodiment of a display means according to the invention.

A preferred embodiment of a display unit according to the invention is represented in perspective and partially in cross section by FIG. 1. This drawing shows a portion of the screen 1 with one surface 2 being visible and an opening 3 bordered by a lateral wall 4. Within opening 3, slightly retracted, there is a pivoting means 5, only the lower portion of which is shown. In this embodiment the pivoting means is an essentially rectangular flap with two principal surfaces 6, 6' opposite each other, only surface 6 being visible. The lateral extremities of the flap are bisected in this example, but other configurations might be used. Flap 5 has a longitudinal axis of symmetry a—a' around which it can rotate. To allow it to rotate, each extremity of the shutter has a shaft pivoting on a platform constructed in an extension connected to a framework, not shown, said framework also supporting screen 1. In FIG. 1, only shaft 7 and extension 8 are shown, but another similar shaft and another arm are situated in the region of the other extremity of the flap. Shaft 7 penetrates extension 8 and, at its free end, a gear wheel 9 is attached. This gear meshes with a pinion 10 supported on a shaft 11 pivoting in a platform in extension 8, and in another platform in a second extension 12 also connected to the framework, not shown.

A stepping motor 13, comprised of a shaft 14 and a discharge coil 15, is disposed beneath extension 12 in such a way that the axis of shaft 14 falls within the extended portion of the axis of shaft 11. Motor 13 is attached to the framework by means not shown, and shafts 11 and 14 are interconnected by an elastic means 16 which, in this embodiment, is in the form of a thin metallic plate; however, other connecting means could be used between the two shafts, such as, for example, a spring or a tube of flexible synthetic material. Finally, motor 13 is engaged by application of controlling electrical impulses to the terminals A and B of discharge coil 15. With each electrical impulse, shaft 14 of the motor effects a rotation of a predetermined angle, usually 180°. Rotation always takes place in the same direction if the motor is unidirectional, or in one direction and then the opposite direction if the motor is bidirectional. In the latter case, the motor may advantageously be a bi-or poly-phase motor and have two or more discharge coils, rather than being a monophase motor with only one coil.

The display unit shown in FIG. 1 functions as follows. With each controlling electrical impulse applied to terminals A and B, motor shaft 14 effects, for example, a half turn. This motion is transmitted, by means of elastic piece 16, to shaft 11 and then to shaft 7 by virtue of the meshing of gear 9 and pinion 10. As the diameter of the gear is greater than that of the pinion, meshing reduces the rotation speed of shaft 7 and, as a result, of flap 5 in relation to that of shaft 14. Under these conditions, motor 13 must effect several steps in order for shutter 5 to complete a half turn.

One of the principal surfaces of flap 5, for example, surface 6, is the same color as visible surface 2 of screen 1, while the other principal surface 6' is a different color. When principal surface 6 is visible through screen 1, the flap is indistinguishable from visible surface 2. Therefore, the display unit appears to be blank. Conversely, if surface 6' is visible, being of a different color, flap 5 is readily distinguishable from screen 1. This change in appearance of the display unit constitutes its information output.

In order that this information be obtained with minimum electrical expenditure, it is necessary that the moment of inertia of the movable pieces and their angular acceleration during rotation be as low as possible. Low inertia is made possible by using a flap made of a thin sheet of metal or synthetic heat-formed material, or even a sheet of synthetic foam. In the resting state, the position of flap 5 is generally such that its principal surfaces 6, 6' are essentially vertical. The flap thus cannot be deformed by its own weight no matter what the orientation of its axis a—a' in the vertical plane might be. Conversely, during rotation, if axis a—a' is horizontal, the shutter may lurch forward when its principal surfaces are uniformaly horizontal. However, moderate deformation is perfectly acceptabe during motion. The motor 13 decreases the speed of flap 5, on the one hand, by virtue of the elastic portion 16 which absorbs abrupt angular speed variations of axis 14 and, on the other hand, by means of the meshing of gear 9 and pinion 10. The result is that the shutter rotates more regularly and slowly, a factor favoring energy conservation.

The decreased ratio caused by the meshing of gear 9 and pinion 10 results in a compromise between the energy absorbed by shutter 5 during a rotation greater than 180° and the maximum time acceptable to effect this movement. Depending upon the dimension of the flap, this ratio may vary, but is never lower than 12, which value corresponds to the angle of rotation of 15° per motor step. Flexibility of elastic means 16, on the other hand, is determined as a function of the moment of inertia of the movable elements associated with axis 11 and the torque of motor 13. The lower the torque, the more flexibility required of the elastic element.

Very low powered stepping motors may be used to control the flap, for example, between 1 and 100 $\mu$W, the amount of power required being a function of the size of the flap, the reduction ratio between the gear and the flexibility of the elastic element. Motors of this type are widely used in clock and watch movements and in similar mechanisms with small pendulums. As they are mass produced, these motors are economical. Therefore, the display unit according to the invention can be sold inexpensively, as it has a simple design and structure and contains no expensive parts.

The energy-saving display element as described above may be used to form display units showing more complex information. An example of such a unit is shown in FIG. 2, which shows a display unit well known in the art with seven segments a, b, c, d, e, f and g. This unit comprises a screen 20 with seven openings 21 and seven flaps 22 disposed within the openings. The flaps are identical to those of FIG. 1 and each flap is controlled by a separate motor. In this embodiment, the flaps are positioned to show the number 3, that is, segments "e" and "f" are the same color as screen 20, while segments "a", "b", "c", "d" and "g" are a different color.

Energy consumption for such a unit, which is 10 cm high and might display time in seconds, could be less than 10 $\mu$W. This compares with 54 $\mu$W for a liquid crystal display unit the same size as that described above.

Naturally, the display mechanism according to the invention could comprise display elements with more segments or could even be a series of matrix type units wherein each segment is generally square-shaped.

In order for the drive mechanism to be completely covered by screen 20, the stepping motors should not be disposed within the extensions of the corresponding flaps, as in FIG. 1.

A more compact version of the mechanism is shown in plane and in elevation, in FIGS. 3A and 3B, respectively, wherein contiguous flaps form segments "e" and "d" of FIG. 2. Flap 22 of segment "d", for example, is affixed at one of its extremities, to shaft 25 rotating in a platform on support 26 connected to screen 20, not shown in the drawings. Shaft 25 is driven by stepping motor 27, corresponding to motor 13 of FIG. 1, by means of a gear system formed by conical gear 28 connected to the shaft and conical pinion 29 affixed to the motor shaft. This gear system, which allows the motor shaft to be perpendicularly disposed in relation to shaft 25, affords considerable reduction in the amount of space required for the flap drive mechanism. Control of the other flap is similar to that just described. Naturally, other arrangements could be used and the right angle disposition could be achieved by means of an endless screw instead of conical gears.

It is obvious that the display mechanism just described could be modified in various ways and other embodiments might easily be conceived by one skilled in the art without departing from the scope of the present invention.

I claim:

1. Display means comprising:

a pivotable means having a low moment of inertia and at least two differently colored principal surfaces, said pivotable means being rotatable through predetermined angles between at least two stop positions wherein respective principle surfaces are displayed, a rotary stepper motor operably connected to said pivotable means by rotary drive means whereby said pivotable means is rotated over less than 15 degrees for each step of the stepper motor, said predetermined angles each corresponding to several steps of the stepper motor, and said stop positions being determined by said stepper motor, and elastic means for absorbing forces resulting from angular speed variations caused by the stepper motor operatively disposed between the stepper motor and the pivotable means.

2. Display means according to claim 1, wherein the pivotable means is a thin flap with two generally rectangular parallel main surface.

3. Display means according to claim 2, wherein the flap is made from a sheet of thin metal.

4. Display means according to claim 2, wherein the flap is heat-formed of synthetic material.

5. Display means according to claim 1, wherein the elastic means is a thin metal plate.

6. Display means according to claim 1, wherein the stepping motor is a clock movement.

* * * * *